US006860433B2

(12) United States Patent
Dietze et al.

(10) Patent No.: US 6,860,433 B2
(45) Date of Patent: Mar. 1, 2005

(54) BEARING FOR A SECTION OF A TRACK

(75) Inventors: Hans-Ulrich Dietze, Wusterwitz (DE); Stefan Schmedders, Butzbach (DE)

(73) Assignees: BWG GmbH & Co. KG, Butzbach (DE); VAE GmbH, Vienna (AT)

( * ) Notice: Subject to any disclaimer, the term of this patent is extended or adjusted under 35 U.S.C. 154(b) by 0 days.

(21) Appl. No.: 10/381,041

(22) PCT Filed: Sep. 25, 2001

(86) PCT No.: PCT/EP01/11046

§ 371 (c)(1),
(2), (4) Date: Mar. 25, 2003

(87) PCT Pub. No.: WO02/27099

PCT Pub. Date: Apr. 4, 2002

(65) Prior Publication Data

US 2004/0035946 A1 Feb. 26, 2004

(30) Foreign Application Priority Data

Sep. 29, 2000 (DE) ..... 100 48 787

(51) Int. Cl.[7] ..... E01B 3/12
(52) U.S. Cl. ..... 238/287
(58) Field of Search ..... 238/151, 287, 238/292, 299, 264, 283

(56) References Cited

U.S. PATENT DOCUMENTS 3,831,842 A * 8/1974 Tamura ..... 238/349
4,155,507 A * 5/1979 Chierici et al. ..... 238/287
4,266,719 A * 5/1981 Ortwein et al. ..... 238/283
4,618,093 A * 10/1986 Young et al. ..... 238/283

FOREIGN PATENT DOCUMENTS

DE 3230565 3/1983
DE 29807791 9/1998
DE 19823812 12/1998

* cited by examiner

*Primary Examiner*—S. Joseph Morano
*Assistant Examiner*—Robert J. McCarry, Jr.
(74) *Attorney, Agent, or Firm*—Dennison, Schultz, Dougherty & MacDonald

(57) ABSTRACT

A bearing for a section of a track includes, along the track sections, profile sections which deviate from each other, especially in the form of points. A plurality of supporting points is provided with a ribbed plate, in addition to an intermediate layer made of an elasticized material disposed between the ribbed plate and an associated railway sleeper. In order to obtain identical subsidences along the sections of track, substantially each support point has an identical maximum subsidence with respect to each excavated track section.

10 Claims, 6 Drawing Sheets

Figure 2:
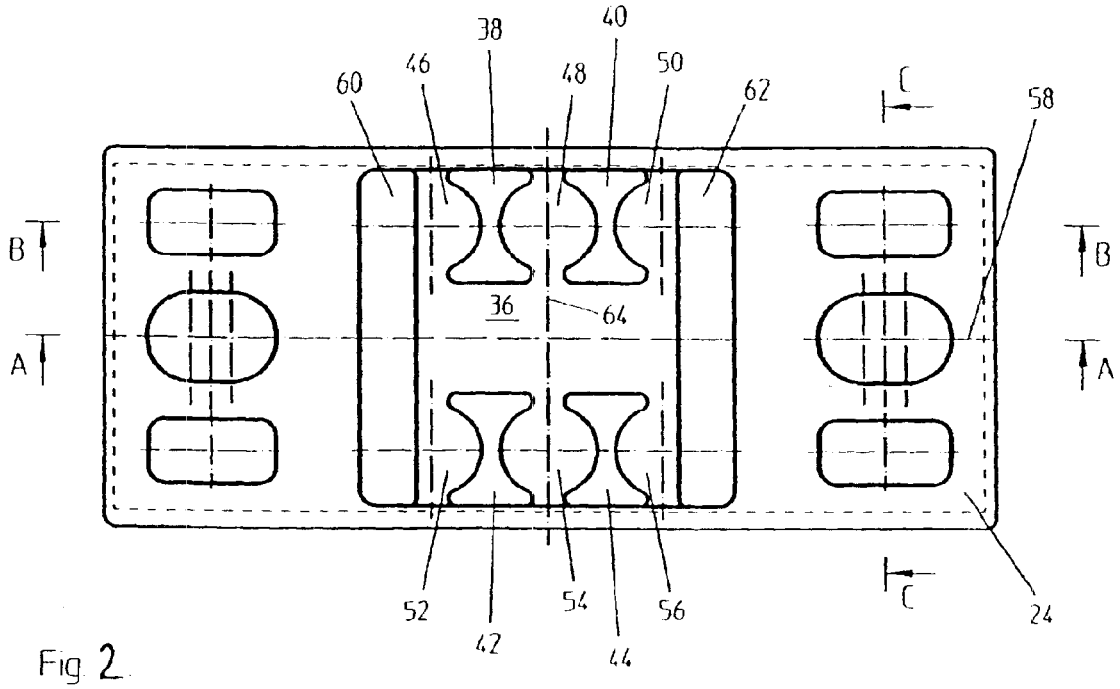

A - A
B - B
118
120
114
112
136
118
120
132
122
136
126
112
118
116
118

BEARING FOR A SECTION OF A TRACK

The invention relates to a bearing for a section of a track having, along the track section, profile sections which deviate from one another, in particular in the form of switch points, comprising a plurality of supporting points respectively provided with a base plate such as a ribbed plate, tongue heel plate, ribbed plate with sliding bedplate or with a support frame in addition to an intermediate plate made of an elastic material disposed between the base plate and an associated support such as a railway sleeper or concrete plate.

To ensure defined elasticities for the roadbed and at the same time obtain a reduction of body sound, elastic intermediate plates are disposed between the the base plates, such as ribbed plates, housing the track and the support, such as sleepers or concrete plates, it being used both in macadam construction and also in a solid roadway. The elastic intermediate plates used may consist of cellular elastomers such as PU foams which have a spring rigidity which is approximately linearly dependent on the bearing surface of the base plate. The support points extending along a track, in particular in the area of a point, have various rigidities, depending on whether or not they are situated at the start of the point or at the end of the point.

A deflection curve results in the rail for a wheel passing through a track, said deflection curve being essentially dependent on the moment or resistance or inertia of the rail section over which the wheel load is being cleared, as well as the spring rigidity of the supporting point which, in turn, can be influenced by the elasticity of the intermediate plate. The base plate, such as a ribbed plate, of the supporting point is thereby usually dimensioned in such a way that a wheel load is transmitted without deformation of the base plate.

Consequently, the spring rigidity of a track, which results from the quotient consisting of wheel load and subsidence, deviates in the track from that of a point or a crossing.

A rail arrangement having an elastic intermediate plate can be found in DE 198 23 812 A1 which consists of a one-piece vulcanizate and has an essentially even surface as well as an underside divided into zones with different properties.

DE 32 30 565 A1 relates to a rail base for switch construction which consists of sections of individual plates connected by welding.

A bearing for a section of track is known from DE 298 07 791 U1 which has projections cut out at the support end which extend at a distance from the supporting surface during the normal introduction of force.

The object of the present invention is to improve a bearing of the aforementioned type for a section of track which has rail sections that deviate from one another in their profile sections, in particular in the form of a point in such a way that track-like conditions result, i.e. the deflection curve in the area e.g. of a point or crossing corresponds to that in the normal track.

According to the invention, the object is solved essentially thereby that each or essentially each supporting point of the track section has the same maximum subsidence, taking the rail section or sections cleared from it into consideration. This means that the intermediate plate is disigned with respect to the moment of resistance which is essentially determined by the rail section supported on the base plate or the rail sections supported thereon, in such a way that the same or essentially the same maximum subsidence results along the track section in each supporting point when a wheel travels through the track section.

In particular, it is provided that the respective intermediate plate has a surface extension clearing the base plate which is independent of the load-clearing base surface of the base plate facing the intermediate plate for supporting points intended for rail sections having the same moment of resistance. In other words, an elastic intermediate plate which always has the same clearing surface extends below the base plate independent of its surface extension.

In a further embodiment of the invention, it is provided that the intermediate plate braces the base plate essentially in its front end area vis-à-vis the support when there is no wheel load.

The intermediate plate itself should have bone-shaped recesses extending along each longitudinal edge in the central area which extend at least symmetrically to the transverse axis, in particular, also symmetrically to the longitudinal axis of the intermediate plate.

The geometry of the recesses is preferably selected in such a way that each recess has a length $\mathbf{1}_a$ parallel to the transverse axis of the base and that two recesses disposed in a row extending parallel to the transverse axis have a distance $\mathbf{1}_z$, with $1.1\times 1_a \leqq 1_z \leqq 1.5\times 1_a$. The recesses are thereby limited by a continuous section of the intermediate plate which extend in a set back manner during usual, i.e. not inadmissible wheel loads relative to the free outer surface of the sections of the intermediate plate extending at the front end and supporting the base plate. This also ensures a secure support of the base plate directly below the rail section proceeding from the base plate, so that inadmissible stresses are excluded.

Furthermore, it is provided that a U-shaped further recess is made in the intermediate plate in the respective transverse edge area adjoining the recesses having a bone-shaped geometry, the longitudinal side of said recess having a maximum width which corresponds to the length of the respective peripheral recess.

Figure 5:
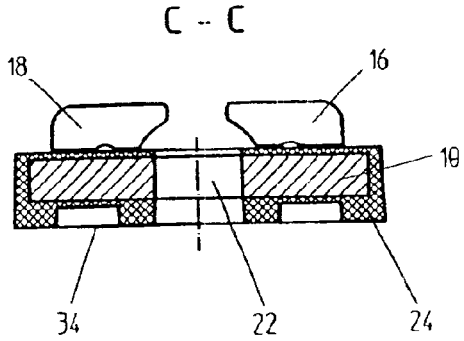
Figure 7:
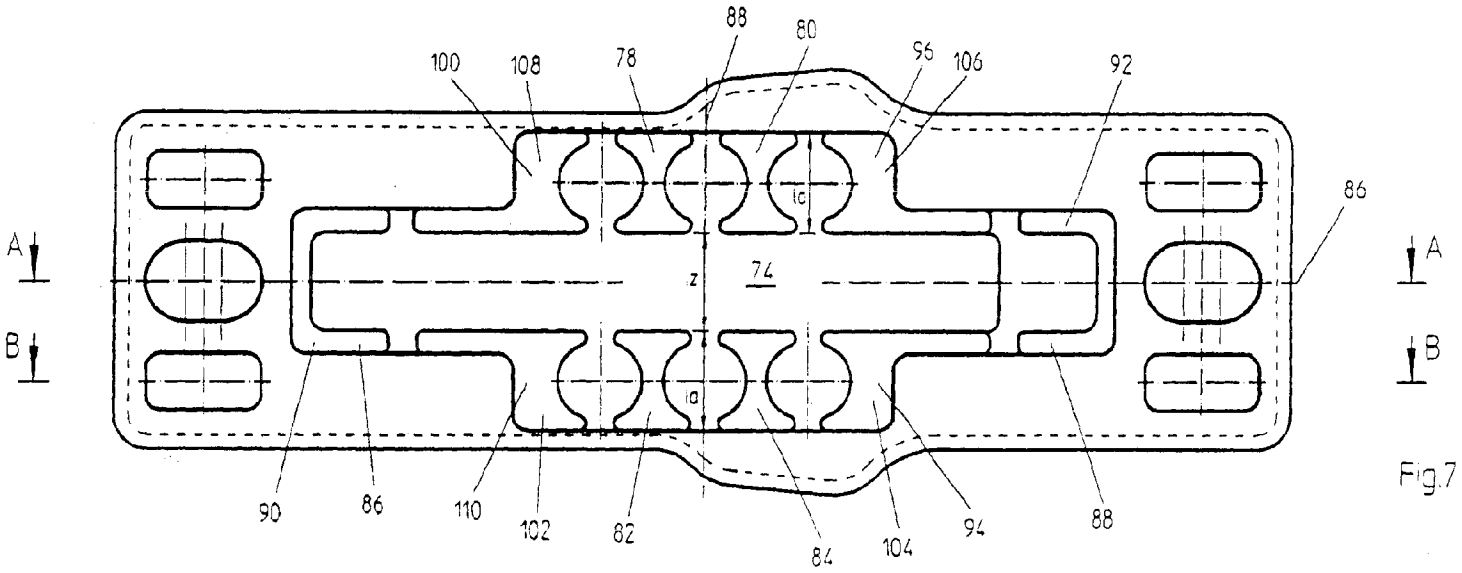
Figure 6:
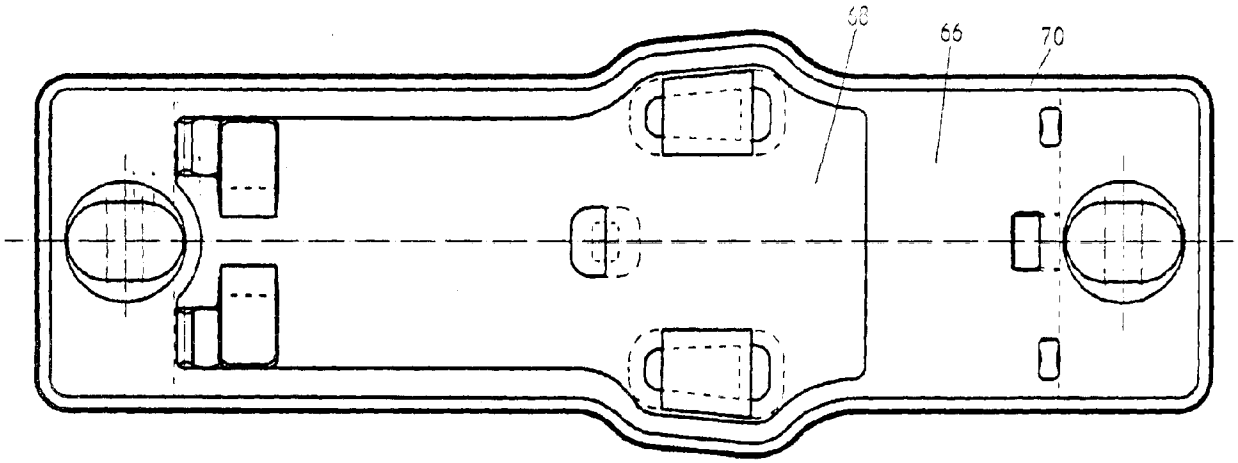
Figure 8:
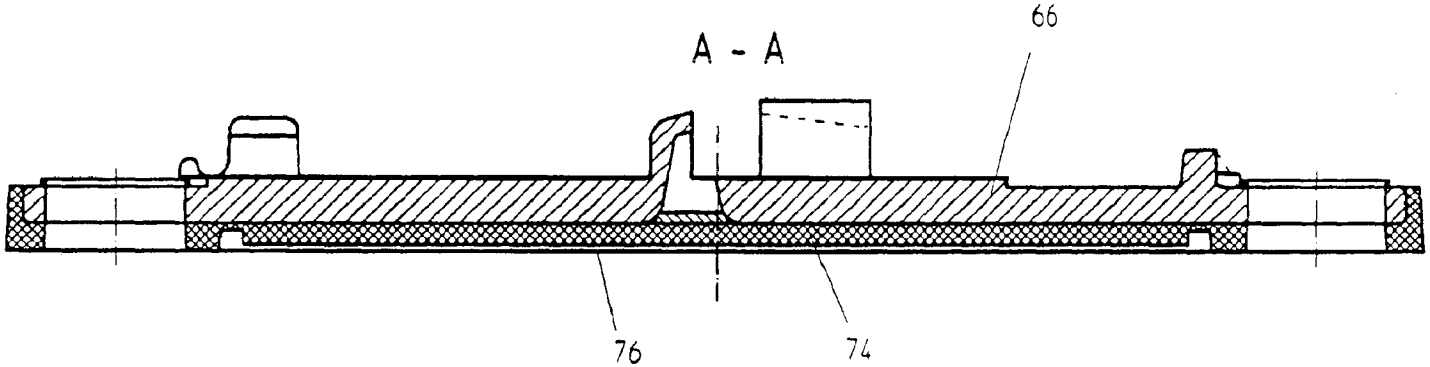
Figure 9:
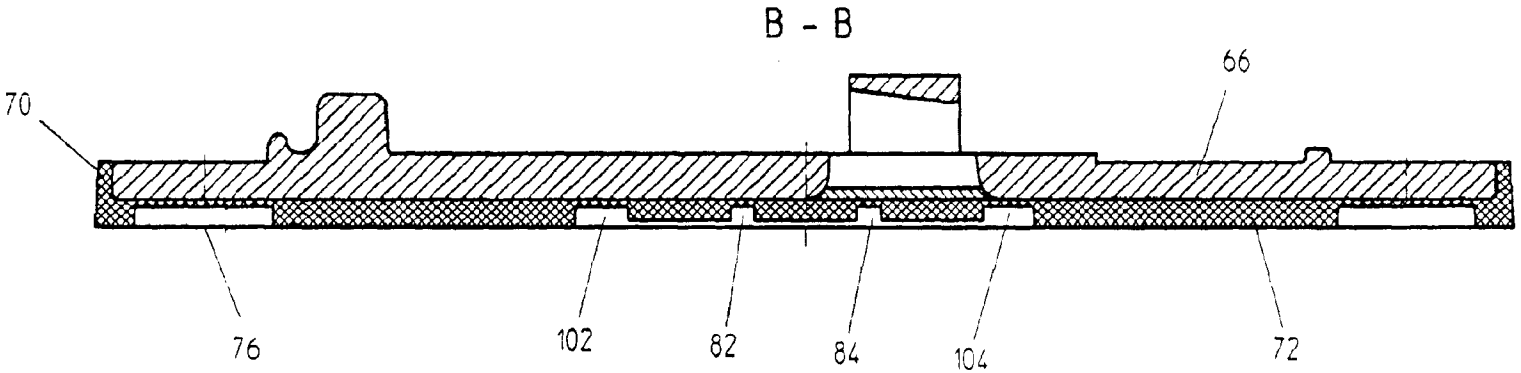
Figures 10, 11:
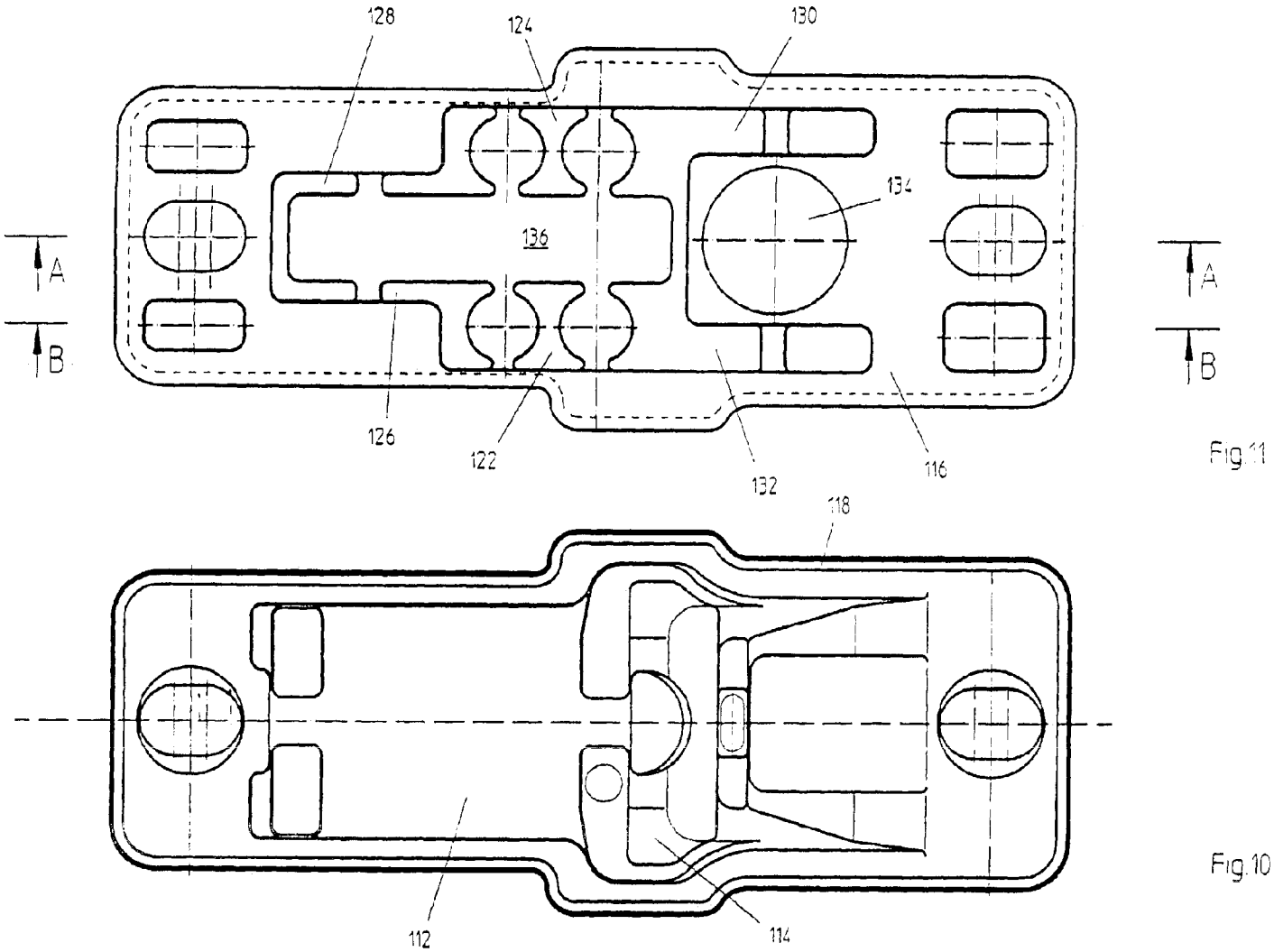

Further details, advantages and features of the invention can be found not only in the claims, the features that can be found therein—alone or in combination—but also in the following description of preferred embodiments that can be found in the drawings, showing FIG. 1 a top view onto a ribbed plate, FIG. 2 a bottom view of the ribbed plate of FIG. 1, FIG. 3 a section along the line A—A in FIG. 1, FIG. 4 a section along the line B—B in FIG. 1, FIG. 5 a section along the line C—C in FIG. 1, FIG. 6 a top view onto a ribbed plate with a sliding bedplate, FIG. 7 a bottom view of the ribbed plate of FIG. 6, FIG. 8 a section along the line A—A in FIG. 7, FIG. 9 a section along the line B—B in FIG. 7, FIG. 10 a top view onto a ribbed plate with support frame, FIG. 11 a bottom view of the ribbed plate of FIG. 10, FIG. 12 a section along the line A—A in FIG. 11, and FIG. 13 a section along the line B—B in FIG. 11.

Elements of supporting points along a switch point can be found in the figures, without these restricting the teaching according to the invention. Rather, this applies quite generally to track sections in which the supporting points with the rail sections supported thereon having moments of resistance that deviate from one another. Based on the teaching of the invention, however, the same maximum subsidence results in each support point when a wheel with the same load travels through it. According to the invention, this is accomplished by placing an elastic intermediate plate between the respective ribbed plate and the support, such as a sleeper or concrete plate, which is primarily designed on the basis of the moment of resistance of the rail section supported on the ribbed plate or the supported rail sections such as stock rail and tongue rail to ensure the same maximum subsidence. It is thereby assumed that the ribbed plate is dimensioned in such a way that the wheel load is passed through without deformation of the ribbed plate. Otherwise, the moment of resistance would also be taken into consideration when designing the intermediate plate for carrying out the teaching of the invention.

Figure 1:
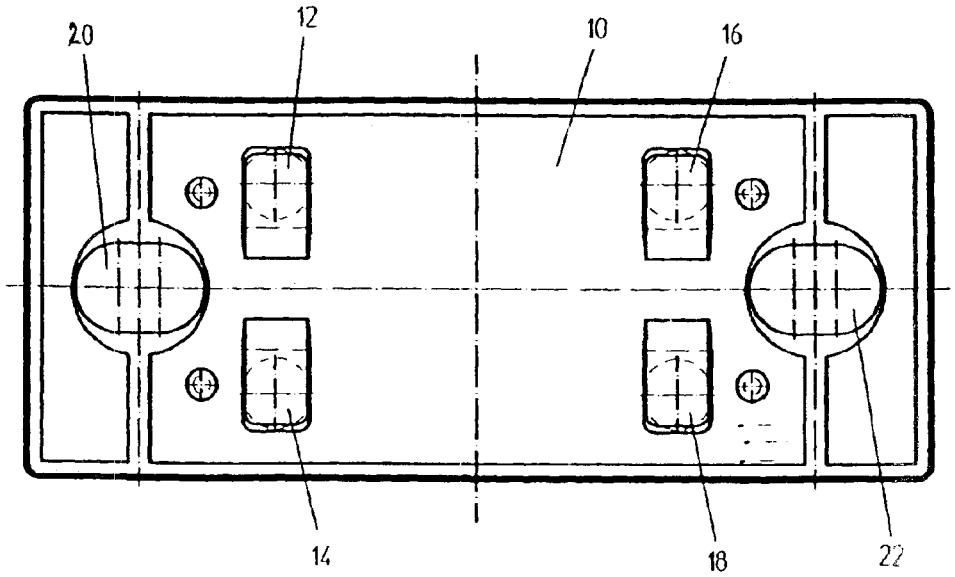

A ribbed plate 10 is shown in FIG. 1 which is disposed, for example, at the start of a switch point. A stock rail (not shown) which, in turn, extends between ribs 12, 14, 16, 18 and is held down by strainers (not shown), is fastened to it. The ribbed plate 10 itself is joined to the support, such as a sleeper or concrete plate, via screws passing through openings 20, 22.

On the bottom, the ribbed plate 10 is provided with an elastic intermediate plate 24. The intermediate plate 24 can thereby completely surround the ribbed plate 10 both on the bottom and also on the ends, as illustrated in the sectional representations of FIGS. 3–5. The connection between the intermediate plate 24 and the ribbed plate 10 can be produced by vulcanization.

Figure 3:
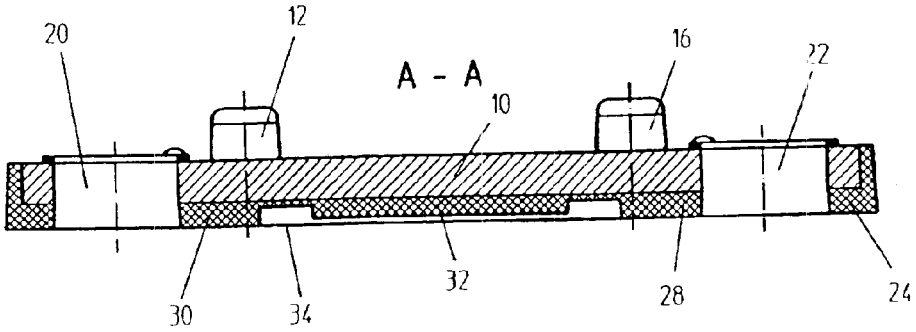
Figure 4:
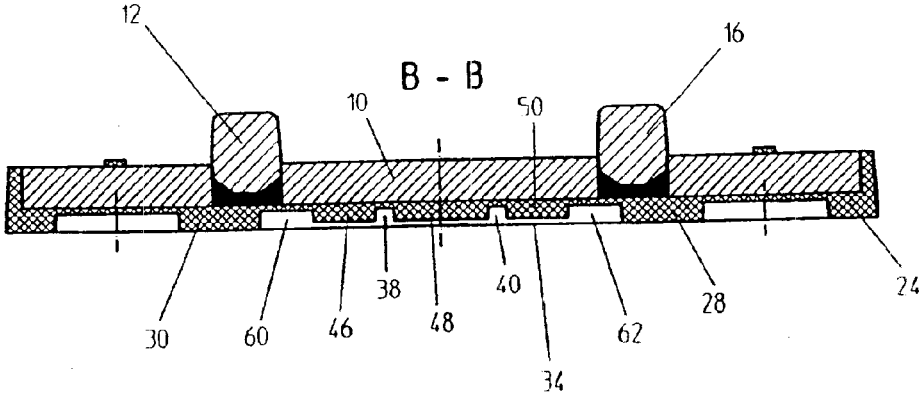

As can be seen in FIGS. 3 and 4, the ribbed plate 10 is supported by front end sections 26, 28 of the intermediate plate 24. When the ribbed plate 10 is unloaded or cleared of normal wheel loads, the sections 32 between said front end sections extends at a distance from the bearing surface 34 of the intermediate plate 24 which can correspond to the surface of a sleeper or a concrete plate or to a plate directly supporting the intermediate plate 24. However, in this respect, reference is made to sufficiently known constructions.

The section 32 itself is composed of a central section 36 as well as sections 46, 48, 50, 52, 54, 56 extending between recesses 38, 40, 42, 44 which together form the section 32. Furthermore, an additional recess 60, 62, rectangular in a top view, extends diagonally to the longitudinal axis 58 of the intermediate plate 24 between section 32 and the front end regions 30, 28, respectively.

The recesses 38, 40, 42, 44 extending in the longitudinal end region have a bone shape and are disposed symmetrically, both to the longitudinal axis 58 and to the transverse axis 64 of the intermediate plate 24.

The recesses 38, 40, 42, 44, 60, 62 produce an overall support surface of the intermediate plate 24 and thus a rigidity, such that the maximum subsidence of a supporting point given by the ribbed plate 10 attains a desired value which is also predetermined by other supports in the area of the point as characteristic quantity, even if the moment of resistance or inertia of the rail sections supported thereon deviate from the arrangement according to FIGS. 1–5. This is obtained thereby that, when increasing the moment of resistance of the permanent way, the rigidity of the corresponding intermediate plate is reduced accordingly, by diminishing the maximum supporting surface or using an intermediate plate material having another elasticity.

In other words, according to the invention, it is provided that the intermediate plate is made softer with increasing moment of resistance of the supporting rail section or sections.

In FIGS. 6–9, a ribbed plate 66 with integrated sliding bedplate 68 is shown along which an elastic intermediate plate 72, comprising its underside and its edge 70, is disposed which supports the ribbed plate 66 essentially in the peripheral area when there is no load or a normal load, whereas section 74 in the centre extends at a distance from a base 76.

According to the embodiment of FIGS. 1–5, the section 74 limits bone-shaped recesses 78, 80, 82, 84 which extend symmetrically to the longitudinal axis 86 and to the transverse axis 88 of the intermediate plate 72. On the edge, U-shaped recesses 86, 88 are provided which are actually composed of two U-shaped base sections 90, 92 and L-shaped sections 94, 96, 98, 100 extending at a distance from them, whose sides 104, 106, 108 and 110 extending parallel to the transverse axis 88 having an extension which corresponds to that of the recesses 78, 80, 82, 84 parallel to the transverse axis 88 of the intermediate plate 72. The recesses 78, 80, 82, 84, 86, 88 are limited by the section 74 of the intermediate plate 72 as is illustrated by a comparison of the top view onto intermediate plates 72 of FIG. 7 with the sectional representations 8 and 9.

Just as the recesses 38, 40, 42, 44 of FIGS. 1–5, the inner recesses 78, 80, 82, 84 which extend in direct vicinity of the transverse axis 88, have a bone shape. As a result, the sections of the intermediate plate 72 extending between the recesses 78, 80, 82, 84 are circular in a top view. The same geometry applies relative to the areas extending between the L-shaped recesses 94, 96, 100, 102 and the adjacent recesses 78, 80, 82, 84.

The recesses 78, 80, 82, 84 having a bone-shaped geometry or the sides 104, 106, 108, 110 extending parallel to the transverse axis 88 have a length $\mathbf{1}_a$ which is less than the distance $\mathbf{1}_z$ between the recesses 78, 82 or 80, 84, respectively. This distance $\mathbf{1}_z$ is about 20–50% greater than the length of the recesses $\mathbf{1}_a$.

Due to the greater moments of resistance of the rail sections supported on the ribbed plate 66 with sliding bedplate 68, i.e. stock rail and tongue rail, in comparison to the moment of resistance of the stock rail fixed to the ribbed plate 10, the intermediate plate 72 has a lower rigidity than the intermediate plate 24 of FIG. 2.

Figures 12, 13:
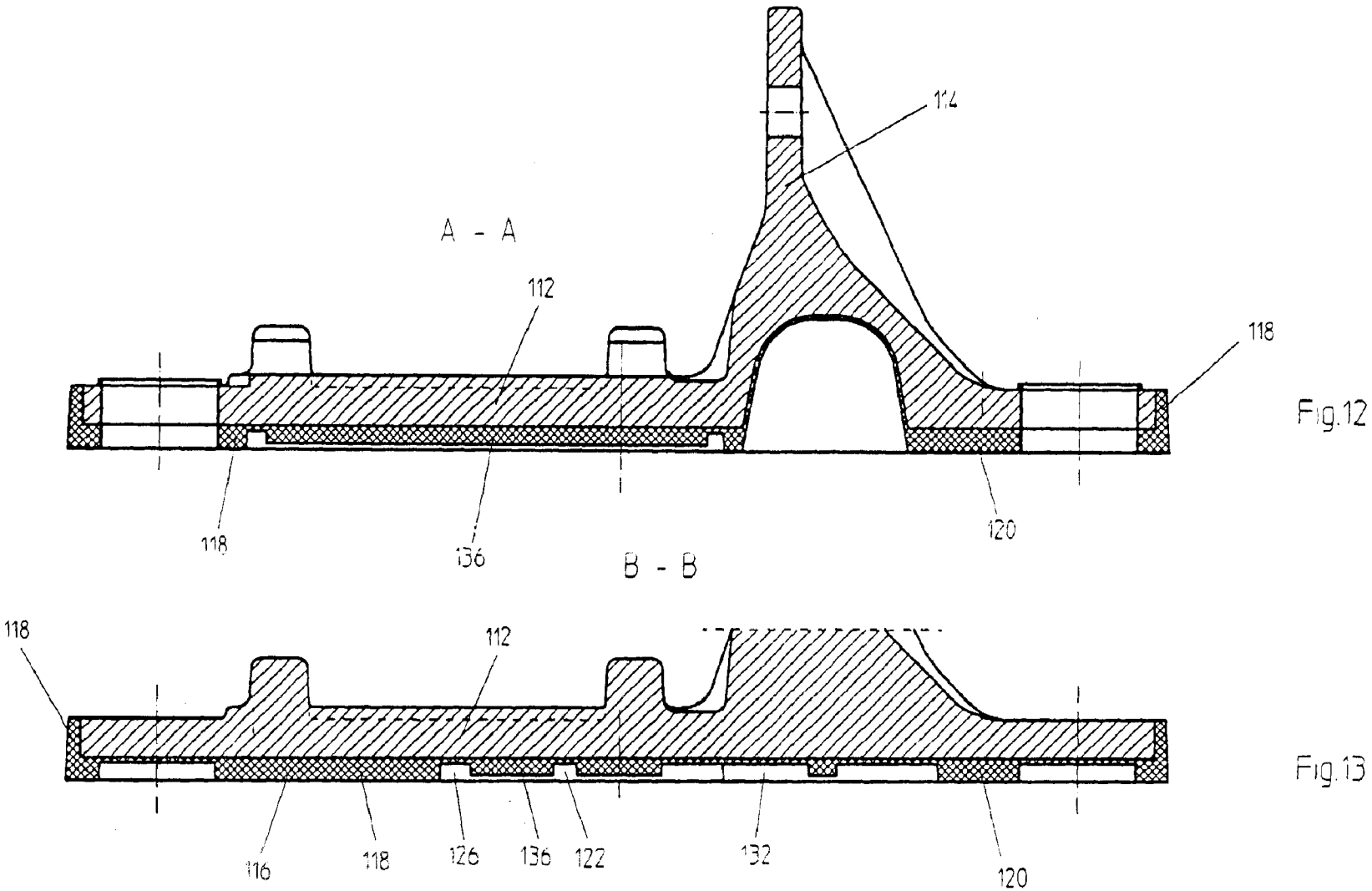

If the moment of resistance of a rail section in a supporting point is even greater, then the rigidity of the intermediate plate is even further reduced accordingly, as is going to be shown with reference to FIGS. 10–13. Thus, a ribbed plate 112 with a support frame 114 is shown from which a guide rail proceeds. In other words, the ribbed plate 112 is disposed in the region of a frog. According to the embodiment of FIGS. 1–9, an elastic intermediate plate 116 which surrounds the ribbed plate 114 on the periphery (edge 118 of the intermediate plate 116 in FIG. 10) extends along the underside of the ribbed plate 112. The intermediate plate 116 also has peripheral sections 118, 120 via which the ribbed plate 112 is usually cleared. Bone-shaped recesses 122, 124 or U-shaped recesses 126, 128, 130, 132 are provided in the central region of the ribbed plate 112, the U-shaped recesses 126, 128 corresponding to the recesses 86, 88 of FIG. 7. The geometry of the bone-shaped recesses 122, 124 corresponds to that of the previously described embodiments, which produces a symmetrical arrangement to the longitudinal axis 134 of the intermediate plate 116. A section 136 of the intermediate plate 116 also extends between the recesses 122, 124, 126, 128, 130, 132, said section extending in a set back manner relative to the peripheral sections 118, 120 during normal wheel loads which act on the ribbed plate 112, as the sectional representations of FIGS. 12 and 13 show.

Independent hereof, however, the rigidity of the intermediate plate 116 is selected in such a way that the maximum subsidence of a wheel passing through the supporting point predetermined by the ribbed plate 112 corresponds to the supporting point comprising the ribbed plates 10 and 66.

What is claimed is:

1. A bearing for a section of a track having, along the track sections, profile sections which deviate from one another, in the form of a switch point, comprising a plurality of supporting points respectively provided with a base plate (10) and a rectangular intermediate plate (24, 72, 116) made of an elastic material disposed between the base plate (10, 66, 68, 112, 114) and an associated support having a bearing surface (34), with transverse edges extending in longitudinal direction of the track section and with longitudinal edges extending diagonally to the track section which extend along the longitudinal axis of the intermediate plate, each supporting point having an identical maximum subsidence with respect to each cleared track section or track sections by support by adjusting spring rigidity of the intermediate plate and moment of resistance of the track section supported on the supporting point, characterized therein that the intermediate plate (24, 72, 116) has a first section surrounding the base plate on the edge and supporting it on the bearing surface (34) and a second section (32) within the first section spaced from the bearing surface when the base plate is cleared from unloaded or common wheel loads and that the second section has recesses (38, 40, 42, 44, 78, 80, 82, 84, 122, 124) with a bone-shaped geometry extending the central region of the intermediate plate proceeding from each longitudinal edge symmetrically to the longitudinal axis of the intermediate plate which are limited by a continuous third section (34, 76) of the intermediate plate which is spaced from the bearing surface when the base plate is clearing unloaded or common wheel loads.

2. The bearing according to claim 1, characterized therein that the recesses (38, 40, 42, 44, 78, 80, 82, 84) are disposed symmetrically to both the longitudinal axis (58, 86) and to the transverse axis (64,88) of the intermediate plate (24, 72) extending in the direction of the track section.

3. The bearing according to claim 1, wherein each recess (38, 40, 42, 44, 78, 80, 82, 84, 122, 124) with a bone-shaped geometry has a length $l_a$ extending in direction of the track section and that recesses disposed in a row extending parallel to the transverse axis (64, 88) have a distance $l_z$ with $1.1 \times l_a \leqq l_z \leqq 1.5 \times l_a$.

4. The bearing according to claim 1, wherein the intermediate plate (24, 22) has a U-shaped further recess (86, 88, 126) in the respective transverse end region adjacent to the recesses (78, 80, 82, 84, 122, 124) having a bone-shaped geometry, the longitudinal side of said U-shaped further recess having a maximum width which corresponds to the length $l_a$ of the bone-shaped recess.

5. The bearing according to claim 1, characterized therein that supporting points for rail sections with the same moment of resistance have elastic intermediate plates (24) with the same load-clearing surface whose extension is dependent of the bottom surface of the base plate facing the intermediate plate.

6. The bearing according to claim 1, wherein supporting points for rail sections with different moments of resistance have intermediate plates (24, 72, 120) with different rigidities.

7. The bearing according to claim 1, wherein the base plate is a ribbed plate.

8. The bearing according to claim 1, wherein the base plate further comprises a sliding bedplate.

9. The bearing according to claim 1, wherein the bearing surface is a railway sleeper.

10. The bearing according to claim 1, wherein the bearing plate is a concrete plate.

* * * * *